US012030684B2

(12) United States Patent
Komai et al.

(10) Patent No.: US 12,030,684 B2
(45) Date of Patent: Jul. 9, 2024

(54) PACKAGING APPARATUS

(71) Applicant: ISHIDA CO., LTD., Kyoto (JP)

(72) Inventors: Naoki Komai, Ritto (JP); Hideyuki Nomi, Ritto (JP); Tomohiko Seno, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 0 days.

(21) Appl. No.: 18/057,023

(22) Filed: Nov. 18, 2022

(65) Prior Publication Data

US 2023/0159206 A1 May 25, 2023

(30) Foreign Application Priority Data

Nov. 22, 2021 (JP) ..... 2021-189660

(51) Int. Cl.
*B65B 57/04* (2006.01)
*B65B 7/16* (2006.01)
(Continued)

(52) U.S. Cl.
CPC ..... *B65B 57/04* (2013.01); *B65B 7/164* (2013.01); *B65B 7/2878* (2013.01); *B65B 41/12* (2013.01);
(Continued)

(58) Field of Classification Search
CPC ..... B65B 7/164; B65B 7/2878; B65B 41/12; B65B 41/16; B65B 41/18; B65B 57/04;
(Continued)

(56) References Cited

U.S. PATENT DOCUMENTS 3,331,320 A * 7/1967 Young et al. ..... B65B 61/025 101/292
4,753,059 A * 6/1988 Natterer ..... B65B 61/025 53/131.5
(Continued)

FOREIGN PATENT DOCUMENTS

DE 10 2009 012 817 A1 10/2009
JP H02-139308 A 5/1990
(Continued)

OTHER PUBLICATIONS

The extended European search report issued by the European Patent Office on May 11, 2023, which corresponds to European Patent Application No. 22208288.5-1014 and is related to U.S. Appl. No. 18/057,023.
(Continued)

*Primary Examiner* — Stephen F. Gerrity
(74) *Attorney, Agent, or Firm* — Studebaker & Brackett PC

(57) ABSTRACT

Providing a packaging apparatus that can inhibit a reduction in printing quality with respect to a film. A packaging apparatus 1 includes: a film conveyance device 100 that conveys a film F; a moving mechanism that conveys a container C having an opening; a sealing device 40 that seals, with the film conveyed thereto by the film conveyance device, the opening of the container conveyed thereto by the moving mechanism; a printer 140 that is disposed upstream of the sealing device in a conveyance path of the film and prints information in a predetermined position on the film while being conveyed; and a controller that controls the operation of the film conveyance device. The film conveyance device has the accumulation mechanism 120. The accumulation mechanism is disposed between the printer and the sealing device in the conveyance path of the film and temporarily accumulates the film printed with the informa-
(Continued)

tion. The controller controls the film conveyance device so that the accumulation mechanism accumulates at least the film that is utilized for one packaging operation in the sealing device.

6 Claims, 7 Drawing Sheets

(51) Int. Cl.

| | |
|---|---|
| ***B65B 7/28*** | (2006.01) |
| ***B65B 41/12*** | (2006.01) |
| ***B65B 41/16*** | (2006.01) |
| ***B65B 41/18*** | (2006.01) |
| ***B65B 61/02*** | (2006.01) |
| ***B65H 20/34*** | (2006.01) |

(52) U.S. Cl.
CPC ..... *B65B 41/16* (2013.01); *B65B 41/18* (2013.01); *B65B 61/025* (2013.01); *B65H 20/34* (2013.01); *B65H 2301/5111* (2013.01); *B65H 2801/81* (2013.01)

(58) Field of Classification Search
CPC ..... B65B 61/025; B65H 20/34; B65H 2301/5111; B65H 2801/81
USPC ..... 53/64, 131.5
See application file for complete search history.

(56) References Cited

U.S. PATENT DOCUMENTS

| | | | | |
|---|---|---|---|---|
| 4,999,973 | A | 3/1991 | O'Brien | |
| 5,964,151 | A | 10/1999 | Mathea | |
| 6,164,200 | A | 12/2000 | Mathea | |
| 6,564,710 | B1 | 5/2003 | Mathea | |
| 7,392,634 | B1 * | 7/2008 | Maye et al. ..... | B65B 61/025 53/553 |
| 8,950,163 | B2 | 2/2015 | Fischer et al. | |
| 2006/0000540 | A1 * | 1/2006 | Mathea ..... | B65B 61/025 156/64 |

FOREIGN PATENT DOCUMENTS

| | | | |
|---|---|---|---|
| JP | H06-127533 | A | 5/1994 |
| JP | H08-058746 | A | 3/1996 |
| JP | H10-203505 | A | 8/1998 |
| JP | 2006-298486 | A | 11/2006 |
| JP | 4065878 | B2 | 3/2008 |

OTHER PUBLICATIONS

"Information Statement" by a third party and mailed by the Japanese Patent Office on Nov. 7, 2023, which corresponds to Japanese Patent Application No. 2021-189660 and is related to U.S. Appl. No. 18/057,023; with English translation of reasons for submission.

* cited by examiner

PACKAGING APPARATUS

BACKGROUND

Technical Field

The present invention relates to a packaging apparatus. More specifically, the present invention relates to a packaging apparatus that seals, with a film, openings of containers conveyed thereto.

Related Art

Conventionally, packaging apparatus that seal, with a film, openings of containers conveyed thereto are known.

Such packaging apparatus may, as in patent document (JP-A No. H10-203505) for example, be provided with a printer on the conveyance path of the film that seals the openings of the containers, and prints various types of information with the printer on the film while conveying the film.

SUMMARY

Technical Problem

A common problem in packaging apparatus is the demand for improved throughput (the number of containers that can be packaged per unit of time). One conceivable measure for solving this problem is to speedily feed the film to a sealing mechanism that seals, with the film, the openings of the containers.

However, in the packaging apparatus of patent document 1 (JP-A No. H10-203505), if the speed at which the film is fed to the sealing mechanism were to be increased, the time usable for printing on the film would become shorter, the printing quality would drop, and the problem of printing errors would become more likely to occur.

It is an object of the present invention to provide a packaging apparatus that seals, with a film, openings of containers conveyed thereto, the packaging apparatus being able to inhibit a reduction in printing quality on the film even when the film is fed at a high speed to a sealing mechanism that seals the openings of the containers.

Solution to Problem

A packaging apparatus pertaining to a first aspect of the invention includes a film conveyance unit, a container conveyance unit, a packaging unit, a printing unit, and a control unit. The film conveyance unit is configured to convey a film. The container conveyance unit is configured to convey a container having an opening. The packaging unit is configured to seal, with the film conveyed thereto by the film conveyance unit, the opening of the container conveyed thereto by the container conveyance unit. The printing unit is disposed upstream of the packaging unit in a conveyance path along which the film F is conveyed by the film conveyance unit. The printing unit is configured to print information in a predetermined position on the film while the film being conveyed by the film conveyance unit. The control unit is configured to control the film conveyance unit, the container conveyance unit, the packaging unit, and the printing unit. The film conveyance unit has an accumulation mechanism. The accumulation mechanism is disposed between the printing unit and the packaging unit in the conveyance path of the film. The accumulation mechanism is configured to temporarily accumulate the film printed with the information. The control unit is configured to control the film conveyance unit so that the accumulation mechanism accumulates the film that is utilized for at least one packaging operation in the packaging unit.

In the packaging apparatus of the first aspect, the time in which conveyance of the film is stopped or slowed down on the downstream side of the accumulation mechanism in the conveyance path of the film can be utilized for time for printing on the film. For that reason, in the packaging apparatus of the first aspect, time for printing can be ensured and a high printing quality on the film can be maintained.

A packaging apparatus pertaining to a second aspect of the invention is the packaging apparatus of the first aspect, wherein a conveyance speed of the film from the printing unit to the accumulation mechanism is slower than a conveyance speed of the film downstream of the accumulation mechanism.

In the packaging apparatus of the second aspect, by virtue of having the accumulation mechanism, it is not necessary to synchronize the printing speed of the printing unit with the conveyance speed of the film on the downstream side of the accumulation mechanism. For that reason, in the packaging apparatus of the second aspect, a high printing quality on the film can be maintained even when the film is fed at a high speed to the printing unit.

A packaging apparatus pertaining to a third aspect of the invention is the packaging apparatus of the first aspect or the second aspect, wherein the film conveyance unit is configured to convey the film in the printing unit while stopping conveyance of the film in the packaging unit at least for a predetermined period of time.

In the packaging apparatus of the third aspect, by virtue of having the accumulation mechanism, the time in which conveyance of the film is stopped for packaging can be utilized for time for printing on the film by the printing unit. For that reason, in the packaging apparatus of the third aspect, a high printing quality on the film can be maintained.

A packaging apparatus pertaining to a fourth aspect of the invention is the packaging apparatus of the third aspect, wherein the packaging unit is configured to collectively seal, with the film, the openings of a plurality of the containers lined up parallel to the conveyance direction of the film in the packaging unit in the one packaging operation.

In this packaging apparatus, it becomes necessary to feed a length of the film sufficient for the plural containers for every packaging operation by the packaging unit. For that reason, if the packaging apparatus did not have the accumulation mechanism, it would be necessary to complete printing for the plural containers within, at most, the amount of time from the end of a packaging operation to the start of the next packaging operation.

In contrast, because the packaging apparatus of the fourth aspect has the accumulation mechanism, the film can be conveyed and printing can be performed on the film even during execution of the packaging operation, and a high printing quality on the film can be maintained.

A packaging apparatus pertaining to a fifth aspect of the invention is the packaging apparatus of any of the first aspect to the fourth aspect, and further includes a changing unit that changes a maximum film length accumulable by the accumulation mechanism.

In the packaging apparatus of the fifth aspect, even when the size of the containers, the quantity of the containers packaged at one time by the packaging unit, and/or the positions in which the printing unit prints on the film change, the film can be stopped at an appropriate position that will not affect printing by the printing unit when temporarily stopping conveyance of the film.

A packaging apparatus pertaining to a sixth aspect of the invention is the packaging apparatus of any of the first aspect to the fifth aspect, wherein the packaging apparatus is configured to stop a printing operation in the printing unit in a case where the film that is utilized for one packaging operation in the packaging unit is accumulated in the accumulation mechanism.

In the packaging apparatus pertaining to the sixth aspect of the invention, the film conveyance unit stands by in a state in which the film that is used for one packaging operation has been accumulated in the accumulation mechanism, so the film printed with the information can be provided without delay to the packaging unit in correspondence with the timing of the operation of the packaging unit.

At the same time, the accumulation mechanism does not overly accumulate the film, so the size of the accumulation mechanism can be inhibited from becoming excessively large.

Advantageous Effects of Invention

In the packaging apparatus of the invention, the time in which conveyance of the film is stopped or slowed down on the downstream side of the accumulation mechanism in the conveyance path of the film can be utilized for time for printing on the film. For that reason, in the packaging apparatus of the invention, time for printing can be ensured and a high printing quality on the film can be maintained.

DETAILED DESCRIPTION

An embodiment of the packaging apparatus pertaining to the invention will be described below with reference to the drawings. It will be noted that the embodiment of the packaging apparatus described below is merely an example and that many changes in form and detail may be made without departing from the spirit and scope of the disclosure as defined in the claims.

(1) Overview

Figure 1:
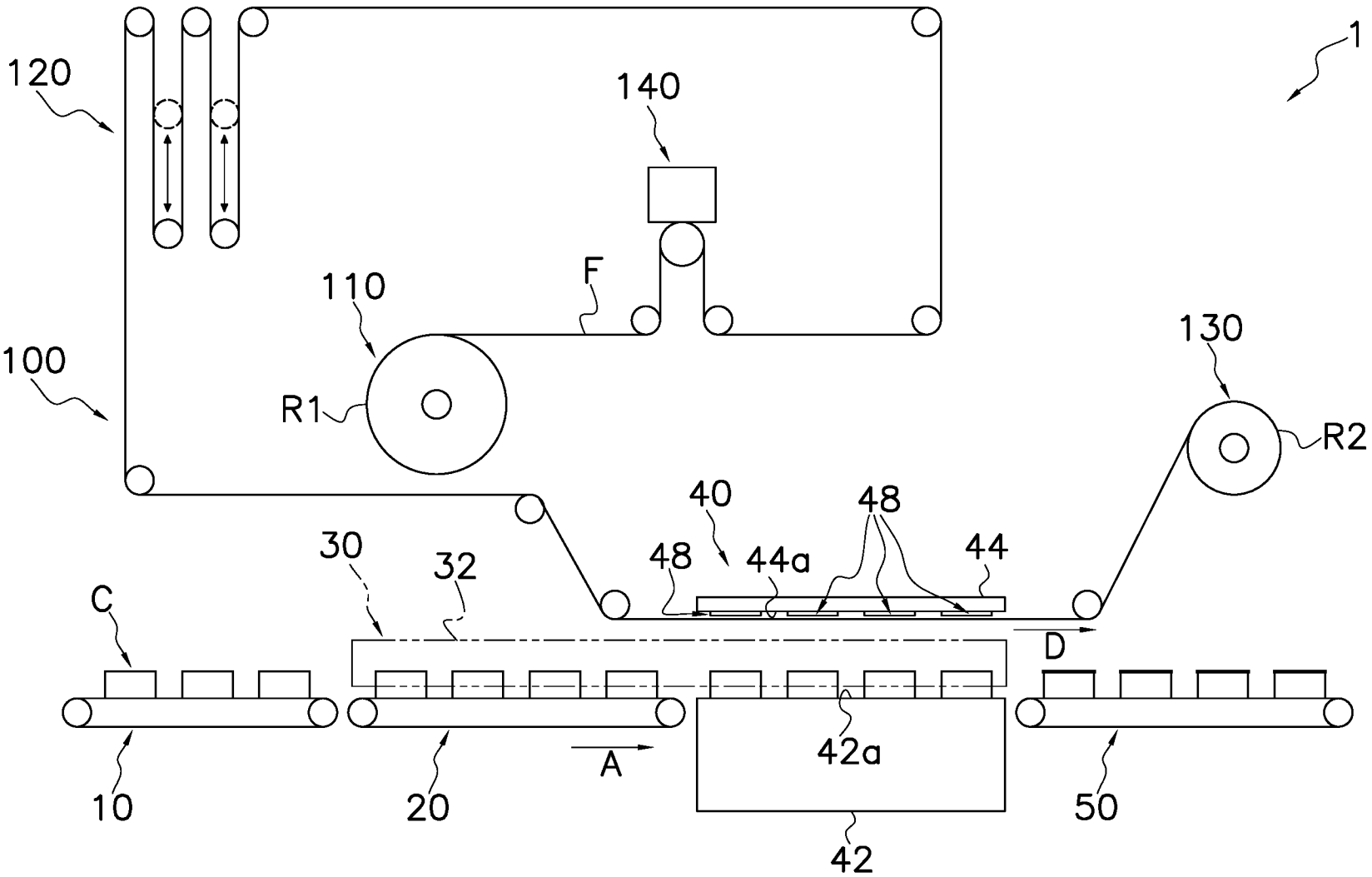
FIG. 1 is a schematic configuration diagram of a packaging apparatus pertaining to an embodiment of the invention.
Figure 2:
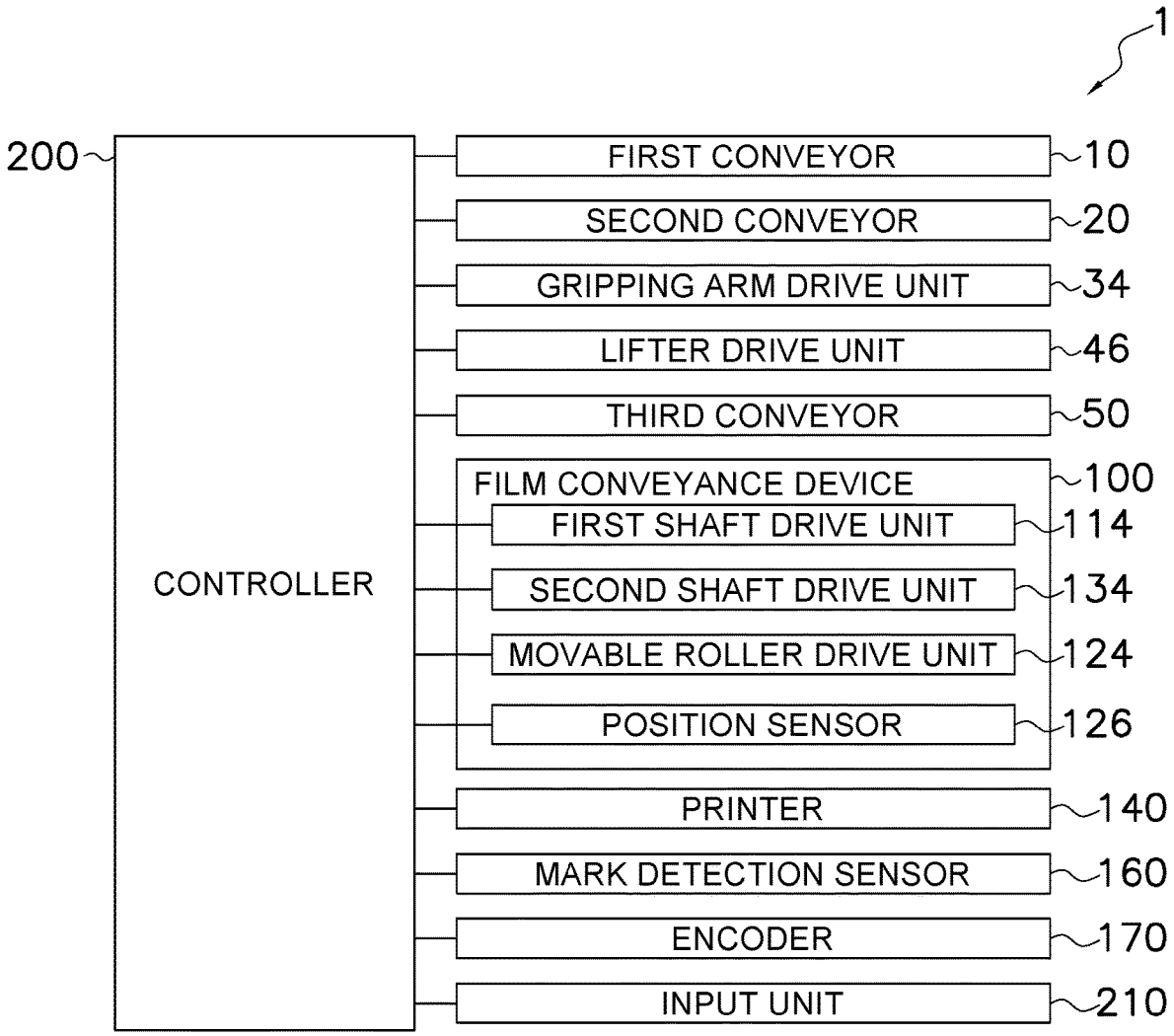
FIG. 2 is a control block diagram of the packaging apparatus of FIG. 1.

The overall configuration of a packaging apparatus 1 pertaining to an embodiment of the invention will now be described with reference to FIG. 1 and FIG. 2. FIG. 1 is a schematic configuration diagram of the packaging apparatus 1. It will be noted that, in FIG. 1, gripping arms 32 of a moving mechanism 30 described later are illustrated as transparent objects using long dashed double-short dashed lines. FIG. 2 is a control block diagram of the packaging apparatus 1.

The packaging apparatus 1 is an apparatus that closes, with a film F, openings in containers C to thereby package, with the film F, the containers C.

Specifically, the packaging apparatus 1 receives tray-like containers C that are filled with contents-to-be-packaged and are conveyed to the packaging apparatus 1. It will be noted that the upper portions of the containers C received by the packaging apparatus 1 have openings. Namely, the packaging apparatus 1 receives the containers C that have been filled with the contents-to-be-packaged but have not yet been packaged by the film F. The packaging apparatus 1 seals (packages), with the film F, the openings in the upper portions of the containers C which the packaging apparatus 1 has received. The packaging apparatus 1 conveys the packaged containers C to a process downstream of the packaging apparatus 1.

It will be noted that, although this is not intended to limit the type of the contents-to-be-packaged, the contents-to-be-packaged are, for example, a food. Although this is not intended to limit the type of the material of the containers C, the material of the containers C is, for example, a plastic such as polypropylene. Although this is not intended to limit the type of the material of the film F, the material of the film F is, for example, a plastic such as polypropylene.

The packaging apparatus 1 will now be more specifically described.

As shown in FIG. 1 and FIG. 2, the packaging apparatus 1 mainly includes a first conveyor 10, a second conveyor 20, a moving mechanism 30, a sealing device 40, a third conveyor 50, a film conveyance device 100, a printer 140, a mark detection sensor 160, an encoder 170, and a controller 200.

The first conveyor 10 receives the containers C conveyed to the packaging apparatus 1 by conveying means such as a conveyor not shown in the drawings. The first conveyor 10 is, for example, a belt conveyor. The first conveyor 10 conveys the containers C to the second conveyor 20.

The second conveyor 20 receives the containers C fed by the first conveyor 10. The second conveyor 20 is, for example, a belt conveyor. A predetermined quantity of the containers C are gathered on the second conveyor 20. The second conveyor 20 is controlled to operate and stop so that the predetermined quantity of the containers C become lined up a predetermined interval apart from each other along a conveyance direction A of the second conveyor 20 (see FIG. 1) on the second conveyor 20.

The moving mechanism 30 moves the predetermined quantity of the containers C that have been gathered on the second conveyor 20 to the sealing device 40. The moving mechanism 30 also moves the containers C that have been packaged by the sealing device 40 (the containers C whose openings have been sealed by the film F) to the third conveyor 50.

The sealing device 40 seals, with the film F conveyed thereto by the film conveyance device 100, the openings of the containers C conveyed thereto by the moving mechanism 30. The containers C that have been packaged by the sealing device 40 are moved by the moving mechanism 30 to the third conveyor 50.

The third conveyor 50 receives the packaged containers C conveyed thereto by the moving mechanism 30 and then conveys the received packaged containers C and hands them over to the downstream process (e.g., conveying means such as a conveyor not shown in the drawings).

The film conveyance device 100 pays out and conveys the film F from a film roll R1 in which the film F is wound and feeds the film F to the sealing device 40.

The printer 140 prints predetermined information such as text and images on the film F before the film F conveyed by the film conveyance device 100 is fed to the sealing device 40.

The mark detection sensor 160 detects marks that have been added at predetermined intervals to the film F conveyed by the film conveyance device 100. The mark detection sensor 160 is used to control the timing of the printing by the printer 140.

The encoder 170 detects the conveyance speed and the conveyance distance of the film F conveyed by the film conveyance device 100. The encoder 170 is used to control the timing of the printing by the printer 140.

The controller 200 controls the operations of the first conveyor 10, the second conveyor 20, the moving mechanism 30, the sealing device 40, the third conveyor 50, the film conveyance device 100, and the printer 140.

(2) Details

Figure 3A:
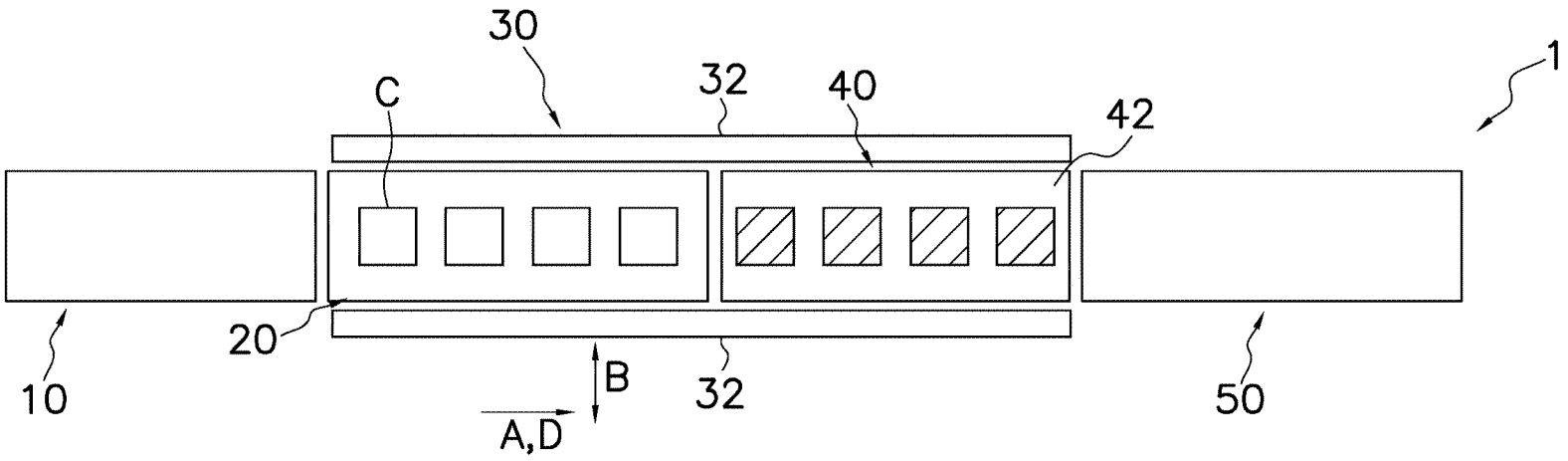
FIG. 3A is a diagram for describing the operation of a moving mechanism of the packaging apparatus of FIG. 1.
Figure 3B:
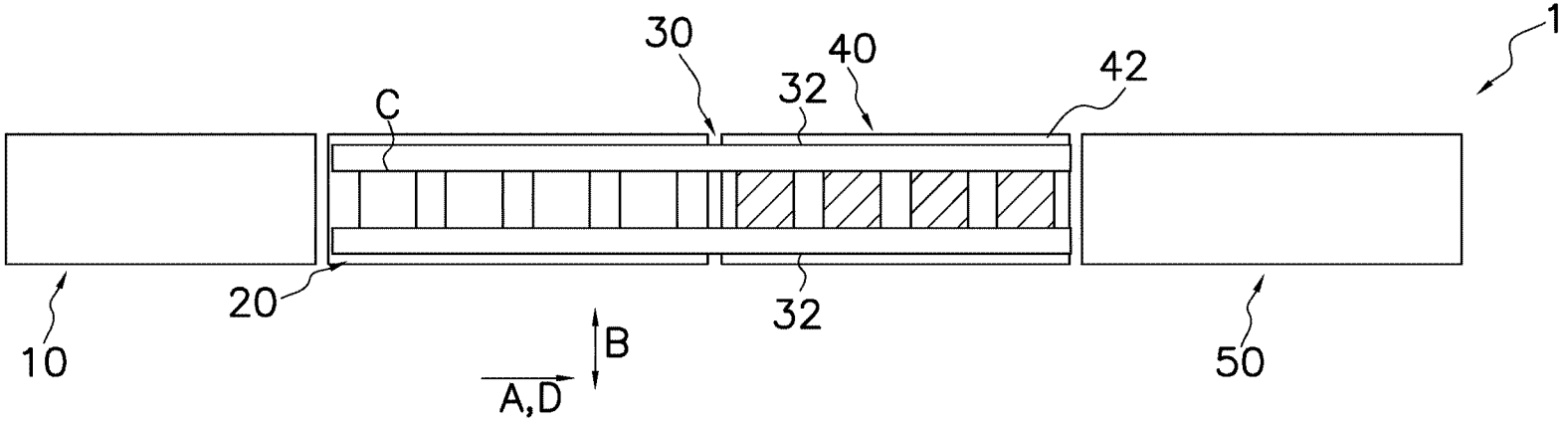
FIG. 3B is a diagram for describing the operation of the moving mechanism of the packaging apparatus of FIG. 1.

The moving mechanism 30, the sealing device 40, the film conveyance device 100, the printer 140, the mark detection sensor 160, the encoder 170, and the controller 200 will now be described in detail with further reference to FIG. 3 to FIG. 4. FIG. 3A to FIG. 3D are diagrams for describing the operation of the moving mechanism 30. In FIG. 3A to FIG. 3D, illustration of the film conveyance device 100, the printer 140, the mark detection sensor 160, and the encoder 170 is omitted. Furthermore, in FIG. 3A to FIG. 3D, the containers C that have been packaged by the film F are shown with hatching added to them. FIG. 4 is a diagram schematically showing configurations in the vicinity of the film conveyance device 100.

(2-1) Moving Mechanism

The moving mechanism 30 is an example of the container conveyance unit that conveys the containers C having the openings. The moving mechanism 30 moves the predetermined quantity of the containers C that have been gathered on the second conveyor 20 onto a later-described lifter 42 of the sealing device 40. The moving mechanism 30 also moves the containers C whose openings have been sealed by the film F (the packaged containers C) and which are placed on the lifter 42 of the sealing device 40 to the third conveyor 50.

The moving mechanism 30 is, for example, a mechanism such as follows, although this is not intended to be limiting.

As shown in FIG. 1 and FIG. 2, the moving mechanism 30 has a pair of gripping arms 32 and a gripping arm drive unit 34 that operates the pair of gripping arms 32.

The gripping arm drive unit 34 is, for example, a pneumatic cylinder, a hydraulic cylinder, or a motor. The gripping arm drive unit 34 may have a plurality of the pneumatic cylinders, hydraulic cylinders, or motors, and the plural pneumatic cylinders, hydraulic cylinders, or motors may work together to operate the gripping arms 32 as follows.

The pair of gripping arms 32 are bar-like members that extend in the conveyance direction A in which the containers C are conveyed by the second conveyor 20.

The pair of gripping arms 32 are members that are movable between a first position and a second position in the conveyance direction A in which the containers C are conveyed by the second conveyor 20. Hereinafter, in the description of the moving mechanism 30, the conveyance direction A in which the containers C are conveyed by the second conveyor 20 will simply be called "the conveyance direction A." The pair of gripping arms 32 in the first position in the conveyance direction A are disposed so that the second conveyor 20 and the sealing device 40 are interposed between the pair of gripping arms 32 in a direction B orthogonal to the conveyance direction A (see FIG. 3A and FIG. 3B). Hereinafter, in the description of the moving mechanism 30, the direction B orthogonal to the conveyance direction A will simply be called "the direction B." The pair of gripping arms 32 in the second position in the conveyance direction A are disposed so that the sealing device 40 and the third conveyor 50 are interposed between the pair of gripping arms 32 in the direction B (see FIG. 3C and FIG. 3D).

The pair of gripping arms 32 are also members that are movable between a third position and a fourth position in the direction B. The pair of gripping arms 32 disposed in the third position in the direction B are spaced further apart from each other than they are when they are disposed in the fourth position. The pair of gripping arms 32 disposed in the third position in the direction B are disposed away from the containers C that are on the lifter 42 of the sealing device 40 and the conveyor 20 or 50 in the direction B (see FIG. 3A and FIG. 3D). In other words, the pair of gripping arms 32 disposed in the third position in the direction B do not contact the containers C even when there are containers C on the lifter 42 of the sealing device 40 and the conveyor 20 or 50 (see FIG. 3A and FIG. 3D). The pair of gripping arms 32 disposed in the fourth position in the direction B contact the containers C that are on the lifter 42 of the sealing device 40 and the conveyor 20 or 50 and sandwich the containers C (see FIG. 3B and FIG. 3C).

The gripping arm drive unit 34 drives the pair of gripping arms 32 so that the pair of gripping arms 32 operates as follows. It will be noted that, as a premise for description, it will be assumed that the pair of gripping arms 32 are in the first position in the conveyance direction A and in the third position in the direction B as shown in FIG. 3A.

When the predetermined quantity of the containers C are gathered on the second conveyor 20 and the packaging of the containers C on the lifter 42 of the sealing device 40 by the film F is finished, the pair of gripping arms 32 are driven by the gripping arm drive unit 34 to move from the third position to the fourth position in the direction B. Then, the pair of gripping arms 32 grip the containers C that are on the second conveyor 20 and on the lifter 42 (see FIG. 3B). The packaging of the containers C by the sealing device 40 will be described later.

Figure 3C:
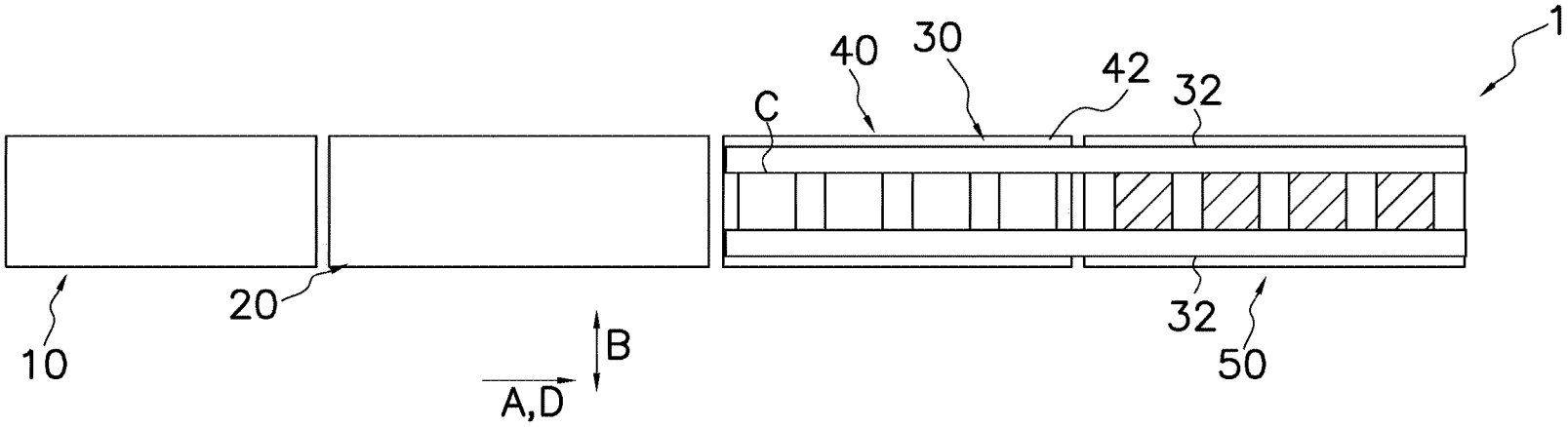
FIG. 3C is a diagram for describing the operation of the moving mechanism of the packaging apparatus of FIG. 1.
Figure 3D:
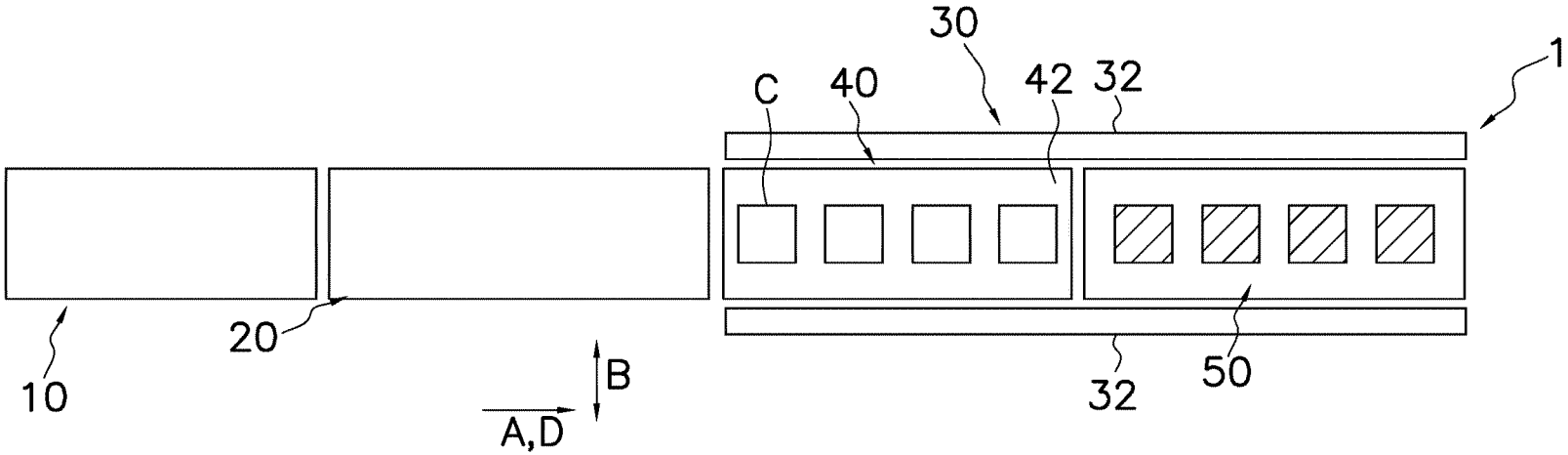
FIG. 3D is a diagram for describing the operation of the moving mechanism of the packaging apparatus of FIG. 1.
Figure 4:
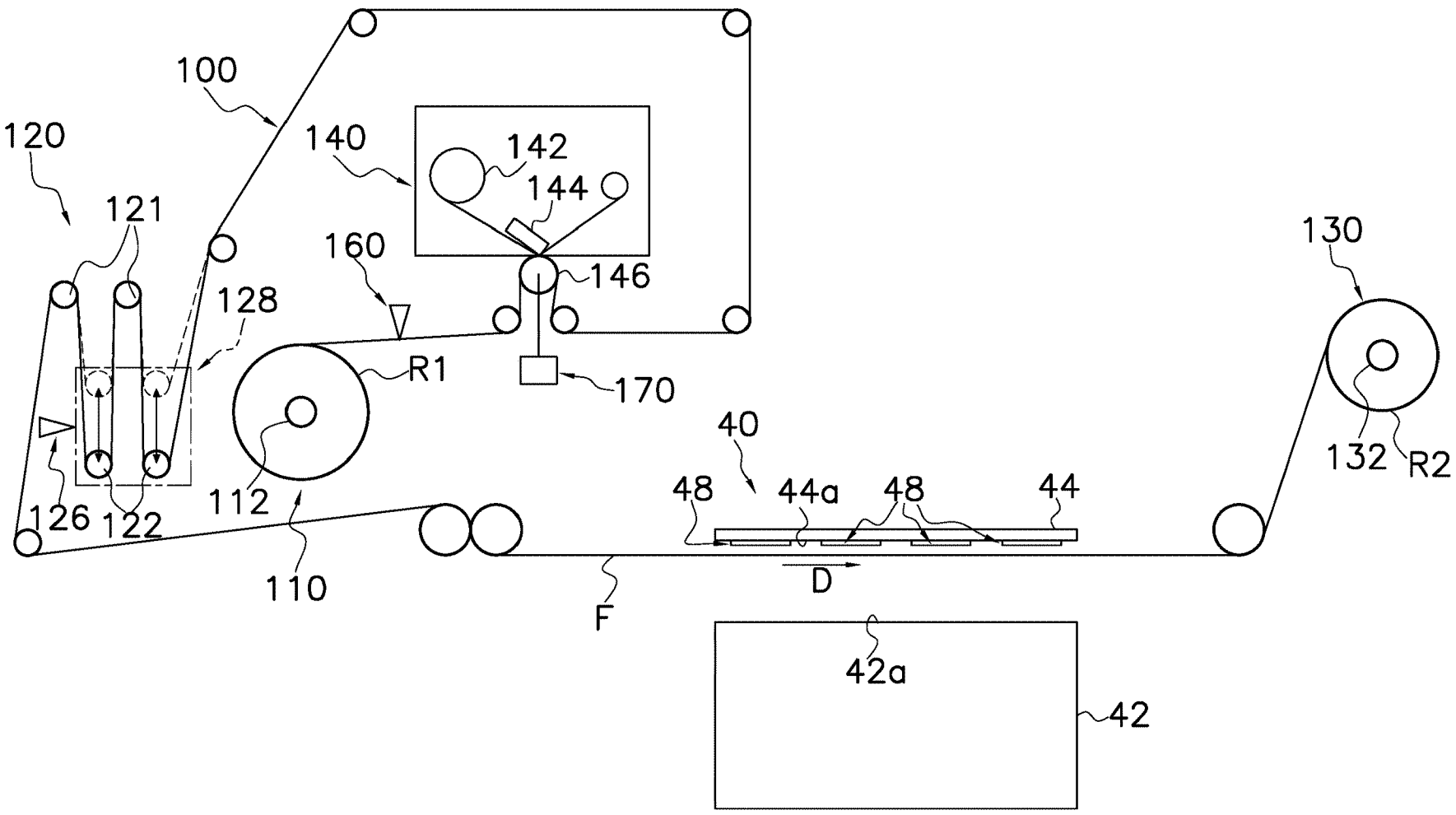
FIG. 4 is a diagram schematically showing a film conveyance device that the packaging apparatus of FIG. 1 has and configurations in the vicinity of the film conveyance device.

Next, the pair of gripping arms 32 are driven by the gripping arm drive unit 34 to move to the second position in the conveyance direction A (see FIG. 3C). As a result, the containers C that were on the second conveyor 20 move onto the lifter 42. Furthermore, the containers C that were initially (before the pair of gripping arms 32 moved to the second position in the conveyance direction A) on the lifter 42 move onto the third conveyor 50. It will be noted that the pair of gripping arms 32 move the containers C that were on the second conveyor 20 onto the lifter 42 and move the containers C that were initially on the lifter 42 onto the third conveyor 50 while maintaining the alignment of the containers C in the conveyance direction A.

In this state, the pair of gripping arms 32 are driven by the gripping arm drive unit 34 to move to the third position in the direction B (see FIG. 3D) so that the gripping of the containers C by the pair of gripping arms 32 is canceled.

Thereafter, the pair of gripping arms 32 are driven by the gripping arm drive unit 34 to move to the first position in the conveyance direction A (see FIG. 3A).

Then, when the predetermined quantity of the containers C are gathered on the second conveyor 20 and the packaging of the containers C on the lifter 42 by the film F is finished, the pair of gripping arms 32 again move to the fourth position in the direction B and grip the containers C that are on the second conveyor 20 and on the lifter 42.

The moving mechanism 30 repeatedly performs this series of operations.

(2-2) Sealing Device

The sealing device 40 is an example of the packaging unit.

The sealing device 40 seals, with the film F conveyed thereto by the film conveyance device 100, the openings of the predetermined quantity of the containers C conveyed thereto from the second conveyor 20 by the moving mechanism 30. In particular, in this embodiment, the sealing device 40 collectively (simultaneously) seals, with the film F in one packaging operation, the openings of a plurality (in this embodiment, four) of the containers C lined up parallel to a conveyance direction D of the film F. The sealing device 40 individually packages product inside the plural containers C in one packaging operation. The containers C whose openings have been sealed with the film F by the sealing device 40 (the packaged containers C) are moved by the moving mechanism 30 to the third conveyor 50.

As shown in FIG. 1 and FIG. 2, the sealing device 40 mainly includes the lifter 42, a plate 44, and a lifter drive unit 46.

As shown in FIG. 1, the film F conveyed by the film conveyance device 100 is conveyed between a placement surface 42*a* of the lifter 42 on which the containers C are placed and an opposing surface 44*a* of the plate 44 that opposes the placement surface 42*a* of the lifter 42.

The lifter drive unit 46 is a mechanism that moves the lifter 42 in a direction toward the plate 44 and a direction away from the plate 44. Although this is not intended to be limiting, the lifter drive unit 46 is, for example, a pneumatic cylinder, a hydraulic cylinder, or a motor.

The plate 44 is provided with tools 48 in positions that correspond, in the conveyance direction A of the second conveyor 20 (the conveyance direction D of the film F) and the direction B orthogonal to the conveyance direction A of the second conveyor 20, to each of the containers C that have been moved by the moving mechanism 30 to the lifter 42.

The tools 48 each have a heater and a cutter not shown in the drawings. The heater of each tool 48 is at least disposed in a position where the film F is sandwiched between the tool 48 and the edge portion of the opening of the corresponding container C (the part of the container C bordering the opening) when, as described later, the lifter 42 has been moved by the lifter drive unit 46 so that the container C moves toward the plate 44. The cutter of each tool 48 is arranged so as to contact the film F and cut the film F at a predetermined position (at an appropriate position in the vicinity of the edge portion of the opening of the container C where the film F has been heat-sealed) when the container C has been moved by the lifter 42 toward the plate 44.

Stating differently the relationship between the positions of the containers C on the lifter 42 and the positions of the tools 48, the moving mechanism 30 moves the containers C that are on the second conveyor 20 to positions that correspond, in the conveyance direction A of the second conveyor 20 and the direction B orthogonal to the conveyance direction A, to the tools 48 provided on the plate 44. To further state this differently, the second conveyor 20 aligns and gathers the predetermined quantity of the containers C on the second conveyor 20 so that the containers C are disposed in positions that correspond to the tools 48 provided on the plate 44 when the moving mechanism 30 has moved the containers C that are on the second conveyor 20 onto the lifter 42.

The lifter 42 is disposed in a predetermined position (a distal position) away from the plate 44 when the lifter 42 receives the containers C conveyed thereto by the moving mechanism 30 from the second conveyor 20. When the moving mechanism 30 moves the predetermined quantity of the containers C from the second conveyor 20 to the placement surface 42*a* of the lifter 42, the lifter drive unit 46 moves the lifter 42 of the sealing device 40 to a predetermined position (a proximal position) so that the placement surface 42*a* of the lifter 42 moves toward the opposing surface 44*a* of the plate 44. More specifically, the lifter drive unit 46 moves the lifter 42 of the sealing device 40 from the distal position to the proximal position so that the edge portions of the openings of the containers C on the lifter 42 contact the heaters of the tools 48 of the plate 44 via the film F. In this way, the edge portions of the openings of the containers C on the lifter 42 contact the heaters of the tools 48 via the film F, whereby the film F is heat-sealed to the edge portions of the openings of the containers C, and the openings of the containers C are sealed by the film F. Furthermore, when the lifter drive unit 46 moves the lifter 42 from the distal position to the proximal position so that the placement surface 42*a* of the lifter 42 moves toward the opposing surface 44*a* of the plate 44, the cutters of the tools 48 contact the film F and cut the film F at the predetermined positions. It will be noted that the film F that was not utilized (the film F that was not used to seal the openings of the containers C) is sent to a recovery roll retention unit 130 described later.

In the sealing device 40, after the lifter 42 has been moved to approach to the plate 44, the lifter drive unit 46 moves the lifter 42 from the proximal position to the distal position so that the lifter 42 moves away from the plate 44. In other words, in the sealing device 40, after the openings of the containers C have been sealed with the film F and the film F (film pieces) for sealing the openings of the containers C has been cut away from the film F conveyed by the film conveyance device 100, the lifter 42 is moved from the proximal position to the distal position so that the lifter 42 moves away from the plate 44. The containers C that are placed on the placement surface 42*a* of the lifter 42 positioned in the distal position and whose openings have been sealed with the film F by the sealing device 40 (the packaged containers C) are moved by the moving mechanism 30 to the third conveyor 50.

(2-3) Film Conveyance Device

The film conveyance device 100 is an example of the film conveyance unit. The film conveyance device 100 pays out and conveys the film F from the film roll R1 in which the film F used to seal the openings of the containers C is wound and feeds the film F to the sealing device 40.

As shown in FIG. 1 and FIG. 4, the film conveyance device 100 mainly has a film roll retention unit 110, a recovery roll retention unit 130, and an accumulation mechanism 120. The film conveyance device 100 uses plural rollers to guide the film F paid out from the film roll R1 retained by the film roll retention unit 110 and feed the film F between the placement surface 42*a* of the lifter 42 of the sealing device 40 and the opposing surface 44*a* of the plate 44. As mentioned above, the film F from which the film F (film pieces) used to seal the openings of the containers C in the sealing device 40 has been cut out (called "used film F") is conveyed to the recovery roll retention unit 130. The used film F conveyed to the recovery roll retention unit 130 is recovered on a recovery roll R2 retained by the recovery roll retention unit 130.

(2-3-1) Film Roll Retention Unit

As shown in FIG. 2 and FIG. 4, the film roll retention unit 110 has a first shaft 112 and a first shaft drive unit 114. The film roll R1 in which the film F is wound is mounted to the first shaft 112. The first shaft drive unit 114 is a mechanism that rotates the first shaft 112. The first shaft drive unit 114 is, for example, a motor. The first shaft drive unit 114 rotates the first shaft 112 to thereby rotate the film roll R1 mounted on the first shaft 112, thus paying out the film F from the film roll R1 and conveying to the sealing device 40 the film F that is paid out.

(2-3-2) Recovery Roll Retention Unit

The recovery roll retention unit 130 has a second shaft 132 and a second shaft drive unit 134. The recovery roll R2, to whose roll core the leading end of the film F paid out from the film roll F1 is connected, is mounted to the second shaft 132. The second shaft drive unit 134 is a mechanism that rotates the second shaft 132. The second shaft drive unit 134 is, for example, a motor. The second shaft drive unit 134 rotates the second shaft 132 to thereby rotate the recovery roll R2 mounted on the second shaft 132, thus taking up the used film F on the recovery roll R2.

It is preferred that the speed for paying out the film F from the film roll F1 by rotating the first shaft drive unit 114 be slower than the speed for taking up the film F on the recovery roll R2 by rotating the second shaft drive unit 134. Specifically, it is preferred that the conveyance speed of the film F between the film roll retention unit 110 and the accumulation mechanism 120 be slower than the conveyance speed of the film F between the accumulation mechanism 120 and the recovery roll retention unit 130. By configuring the speeds in this way, the conveyance speed of the film F from the printer 140 disposed between the film roll retention unit 110 and the accumulation mechanism 120 in the conveyance path of the film F to the accumulation mechanism 120 becomes slower than the conveyance speed of the film F downstream of the accumulation mechanism 120. For example, the average conveyance speed of the film F from the printer 140 to the accumulation mechanism 120 is 0.3 to 0.4 times the average conveyance speed of the film F downstream of the accumulation mechanism 120. By making the conveyance speed of the film F in the printer 140 relatively slower in this way, the amount of time that the printer 140 can use for printing becomes relatively longer, and a reduction in the printing quality of the printer can be inhibited.

(2-3-3) Accumulation Mechanism

The accumulation mechanism 120 is disposed between the film roll retention unit 110 and the recovery roll retention unit 130 in the conveyance path of the film F. More specifically, the accumulation mechanism 120 is disposed between the printer 140, which serves as an example of the printing unit that prints predetermined information such as text and images on the film F, and the sealing device 40, which serves as an example of the packaging unit, in the conveyance path of the film F. The accumulation mechanism 120 is a mechanism that temporarily accumulates the film F on which the information has been printed by the printer 140.

As shown in FIG. 2 and FIG. 4, the accumulation mechanism 120 includes fixed rollers 121, movable rollers 122, a movable roller drive unit 124, and a position sensor 126.

The fixed rollers 121 and the movable rollers 122 are rollers around which the film F is wound and which guide the film F. As shown in FIG. 4, the fixed rollers 121 and the movable rollers 122 are alternately disposed in the conveyance path of the film F. In the example shown in FIG. 4, the accumulation mechanism 120 has three fixed rollers 121 and two movable rollers 122. However, FIG. 4 should not be construed as limiting the numbers of the fixed rollers 121 and the movable rollers 122. The numbers of the fixed rollers 121 and the movable rollers 122 may be appropriately selected.

The fixed rollers 121 are rollers whose positions do not change during operation of the film conveyance device 100. In contrast, the movable rollers 122 are rollers whose positions can be changed to change the length of the conveyance path of the film F. Although this is not intended to limit the moving direction of the movable rollers 122, in the example of FIG. 4, the movable rollers 122 change the length of the conveyance path of the film F by moving generally in the up and down direction between the positions illustrated with solid lines and the positions illustrated with dashed lines.

By virtue of having the movable rollers 122, the accumulation mechanism 120 can temporarily accumulate the film F, particularly the film F on which the information has been printed by the printer 140. It is preferred that at least the film F that is utilized for one packaging operation in the sealing device 40 can be accumulable in the accumulation mechanism 120. Specifically, in the example shown in FIG. 1, it is preferred that at least the film F (the film F on which the information has been printed by the printer 40) sufficient for four containers, which are packaged at one time in the sealing device 40, be accumulable in the accumulation mechanism 120.

The position of the movable rollers 122 is detected by the position sensor 126 that detects the position of the movable rollers 122. The position sensor 126 is, for example, an encoder that detects the amount of rotation of arms (not shown in the drawings) that support the movable rollers 122. The position sensor 126 may also be a device that uses a photoelectric sensor, for example, to detect whether the movable rollers 122 are in a predetermined position.

The movable roller drive unit 124 is a mechanism that drives the movable rollers 122. Although this is not intended to be limiting, the movable roller drive unit 124 is, for example, an air cylinder or a motor. The movable roller drive unit 124 exerts force on the movable rollers 122 to increase the amount of the film F that is accumulated in the accumulation mechanism 120. Although this is not intended to limit the direction in which the movable rollers 122 exerts force on the film F, for example, in the example illustrated in FIG. 4, the movable roller drive unit 124 biases the movable rollers 122 downward so that the movable rollers 122 move downward.

In this embodiment, the film conveyance device 100 uses the first shaft drive unit 114, the second shaft drive unit 134, and the movable roller drive unit 124 to convey the film F. However, the means for conveying the film F are not limited to the first shaft drive unit 114, the second shaft drive unit 134, and the movable roller drive unit 124. The film conveyance device 100 may further have, as means for conveying the film F, a mechanism for film conveyance such as pinch rollers that pinch the film F between a pair of rollers and convey the film F by pulling it.

The timing when the accumulation mechanism 120 accumulates the printed film F and effects obtained as a result of the accumulation mechanism 120 accumulating the printed film F will be described in description of the control of the operations of each part of the packaging apparatus 1 by the controller 200.

(2-4) Printer

The printer 140 is an example of the printing unit.

The printer 140 is disposed upstream of the sealing device 40 in the conveyance path along which the film F is conveyed by the film conveyance device 100. The printer 140 prints the predetermined information such as text and images in predetermined positions on the film F before the film F conveyed by the film conveyance device 100 is fed to the sealing device 40.

In a case where, for example, the product with which the containers C are filled is a food, the information printed on the film F by the printer 140 is the name of the food, the ingredients of the food, allergy information about the food, the date of manufacture of the food, the expiration date of the food, and a barcode, for example. However, the content of the information printed by the printer 140 and exemplified here is merely an example and is not limited to these items of information.

By printing the information in the predetermined positions on the film F by the printer 140, the packaged containers C, to which the film pieces cut out from the film F are attached to the containers C in the sealing device 40, has the information printed in predetermined positions.

The printer 140 is a thermal transfer printer. As shown in FIG. 4, the printer 140 includes an ink ribbon 142, a thermal head 144, and a print roller 146. The printer 140 performs printing by moving the thermal head 144 closer to the print roller 146 while starting to convey the ink ribbon 142, pinching the ink ribbon 142 and the film F between the thermal head 144 and the print roller 146, and transferring hot-melt pigment ink of the ink ribbon 142 to the film F by means of heat of the thermal head 144.

(2-5) Mark Detection Sensor

The mark detection sensor 160 detects marks (alignment marks) added at predetermined intervals along the conveyance direction of the film F to the film F conveyed by the film conveyance device 100.

The mark detection sensor 160 detects, between the film roll R1 and the place where printing is performed by the printer 140 in the conveyance path along which the film F is conveyed by the film conveyance device 100, the marks added to the film F. The mark detection sensor 160 is used to control the timing of printing by the printer 140 so that the predetermined text and images are printed in the predetermined positions on the film F conveyed by the film conveyance device 100.

(2-6) Encoder

The encoder 170 is a sensor that detects the conveyance speed and the conveyance distance of the film F conveyed by the film conveyance device 100.

The encoder 170 is connected to the print roller 146 of the printer 140 and detects, from the rotational speed of the print roller 146, the conveyance speed and the conveyance distance of the film F conveyed by the film conveyance device 100. The encoder 170, together with the mark detection sensor 160, is used to control the timing of printing by the printer 140 so that the predetermined text and images are printed in the predetermined positions on the film F conveyed by the film conveyance device 100.

(2-7) Controller

The controller 200 is an example of the control unit that controls the operations of each part of the packaging apparatus 1.

The controller 200 of this embodiment mainly includes a CPU, a memory comprising a ROM, a RAM, and an auxiliary storage device (e.g., flash memory), and various types of electronic circuits. The controller 200 controls the operations of each part of the packaging apparatus 1 as a result of the CPU reading and executing programs stored in the memory.

It will be noted that the configuration of the controller 200 described here is merely an example of the configuration of the controller 200. The controller of the packaging apparatus 1 may realize the same functions as those of the controller 200 of this embodiment by means of hardware such as a logic circuit or by means of a combination of hardware and software. Furthermore, the controller 200 may be realized by one device or by plural devices.

As shown in FIG. 2, the controller 200 is electrically connected to the first conveyor 10, the second conveyor 20, the third conveyor 50, the gripping arm drive unit 34, and the lifter drive unit 46. The controller 200 is also electrically connected to the first shaft drive unit 114, the second shaft drive unit 134, and the movable roller drive unit 124 of the film conveyance device 100. The controller 200 is also electrically connected to the printer 140. It will be noted that "electrically connected" here means that the controller 200 is connected so as to be able to control the devices to which it is connected. In other words, the controller 200 controls the operations of the conveyors 10, 20, and 50, the film conveyance device 100 serving as an example of the film conveyance unit, the moving mechanism 30 serving as an example of the container conveyance unit, the sealing device 40 serving as an example of the packaging unit, and the printer 140 serving as an example of the printing unit.

The controller 200 is also connected to the position sensor 126, the mark detection sensor 160, and the encoder 170 of the film conveyance device 100 so as to be able to receive information (detection results) from them.

The controller 200 is also configured to be able to receive instructions and information input via an input unit 210 by the operator of the packaging apparatus 1. The input unit 210 may be switches and/or a touch panel provided in the packaging apparatus 1 or may be a unit that receives input sent from a mobile device or the like operated by the operator of the packaging apparatus 1.

The control of the operations of the packaging apparatus 1 by the controller 200 will be described below.

(A) Operations of Each Part of Packaging Apparatus with Respect to Containers

Figure 5:
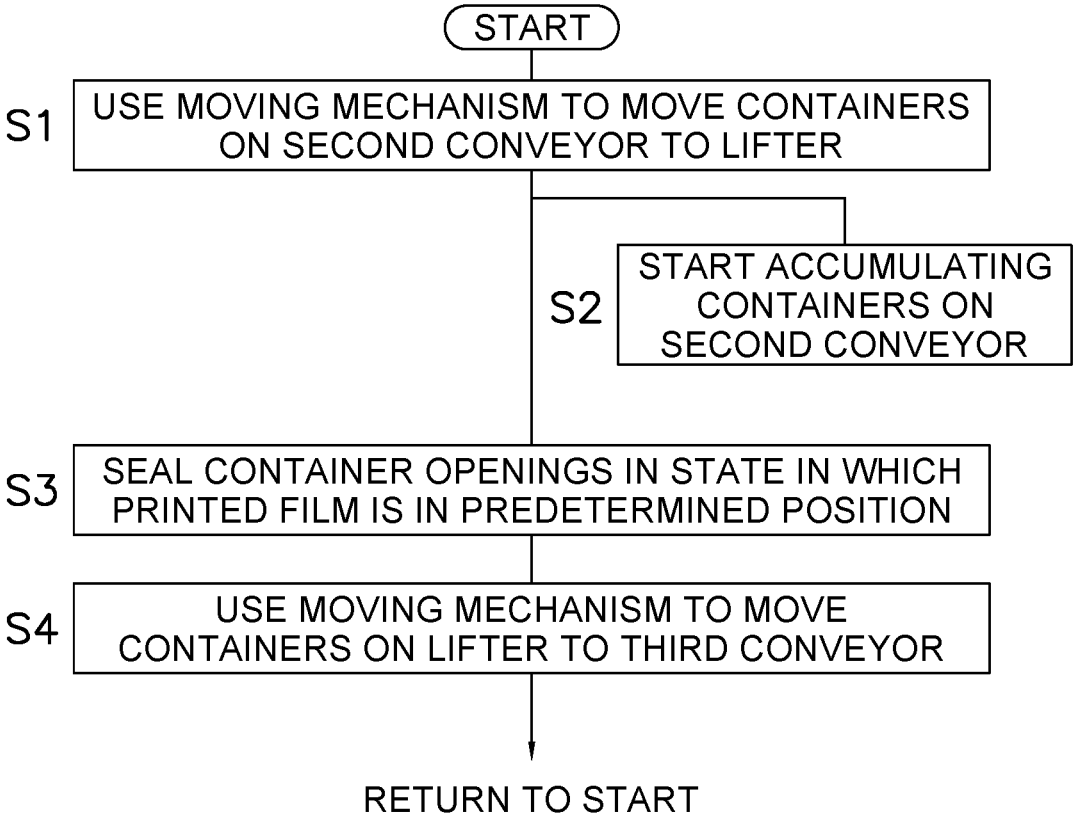
FIG. 5 is a flowchart for mainly describing operations by which containers are packaged by the packaging apparatus of FIG. 1.

The control of the operations of each part of the packaging apparatus 1 with respect to the containers C by the controller 200 will now be described with reference to FIG. 5. FIG. 5 is a flowchart for mainly describing operations by which the containers C are packaged by the packaging apparatus 1.

The controller 200 controls the operation of the first conveyor 10 to convey the containers C received by the first conveyor 10 onto the second conveyor 20. The controller 200 also controls the second conveyor 20 to start and stop so that the containers C become aligned a predetermined interval apart from each other in the conveyance direction A of the second conveyor 20 on the second conveyor 20.

Then, when the predetermined quantity of the containers C are gathered on the second conveyor 20, the controller 200 controls the operation of the gripping arm drive unit 34 so that the predetermined quantity of the containers C on the second conveyor 20 are gripped by the gripping arms 32 as shown in FIG. 3B. Then, the controller 200 moves the gripping arms 32 along the conveyance direction A of the second conveyor 20 to convey the predetermined quantity of the containers C that are on the second conveyor 20 onto the placement surface 42*a* of the lifter 42 of the sealing device 40 as shown in FIG. 3C (Step S1). It will be noted that, as mentioned above, at this time, as shown in FIG. 3C, the moving mechanism 30 moves the predetermined quantity of the containers C that are on the second conveyor 20 onto the placement surface 42*a* of the lifter 42 and also moves the packaged containers C that were on the placement surface 42*a* of the lifter 42 onto the third conveyor 50.

When the movement of the containers C from the second conveyor 20 onto the placement surface 42*a* of the lifter 42 is finished, the controller 200 controls the operation of the gripping arm drive unit 34 to cancel the gripping of the containers C by the gripping arms 32 (see FIG. 3D) and thereafter moves the gripping arms 32 to the position shown in FIG. 3A.

When the moving mechanism 30 moves the predetermined quantity of the containers C that are on the second conveyor 20 onto the placement surface 42*a* of the lifter 42, the controller 200 controls the operations of the first conveyor 10 and the second conveyor 20 to start gathering the predetermined quantity of the containers C on the second conveyor 20 (Step S2). The controller 200 continues to control the operations of the first conveyor 10 and the second conveyor 20 until the predetermined quantity of the containers C are gathered on the second conveyor 20.

In parallel with the control of Step S2, the controller 200 controls the operation of the lifter drive unit 46 to move the placement surface 42*a* of the lifter 42 toward the tools 48 provided in the opposing surface 44*a* of the plate 44 in a state in which the film F is disposed in a predetermined position (an appropriate position relative to the position of the containers C on the placement surface 42*a* of the lifter 42). By doing so, the controller 200 heat-seals, with the heaters of the tools 48, the film F to the openings of the containers C (step S3).

When Step S3 is executed, the cutters of the tools 48 provided in the opposing surface 44*a* of the plate 44 cut the film F at predetermined positions in conjunction with the sealing of the openings of the containers C by the film F. As a result, the film pieces of the film F sealing the openings of the containers C and the film that becomes conveyed to the recovery roll R2 are cut apart from each other.

When the sealing of the openings of the containers C on the placement surface 42*a* of the lifter 42 by the film F in Step S3 is finished, the controller 200 controls the operation of the gripping arm drive unit 34 so that the predetermined quantity of the containers C on the lifter 42 are gripped by the gripping arms 32 as shown in FIG. 3B. Then, the controller 200 moves the gripping arms 32 along the conveyance direction A of the second conveyor 20 to convey the predetermined quantity of the containers C that are on the lifter 42 onto the third conveyor 50 as shown in FIG. 3C (step S4). It will be noted that, as described in the description of Step S1, when Step S4 is executed, the moving mechanism 30 simultaneously moves the predetermined quantity of the containers C that are on the second conveyor 20 onto the placement surface 42*a* of the lifter 42. When the movement of the containers C onto the third conveyor 50 is finished, the controller 200 controls the operation of the gripping arm drive unit 34 to cancel the gripping of the containers C by the gripping arms 32 (see FIG. 3D) and thereafter moves the gripping arms 32 to the position shown in FIG. 3A.

The controller 200 conveys the containers C that are on the third conveyor 50 and hands over the containers C to the process downstream of the packaging apparatus 1.

(B) Operation of Film Conveyance Device

Figure 6:
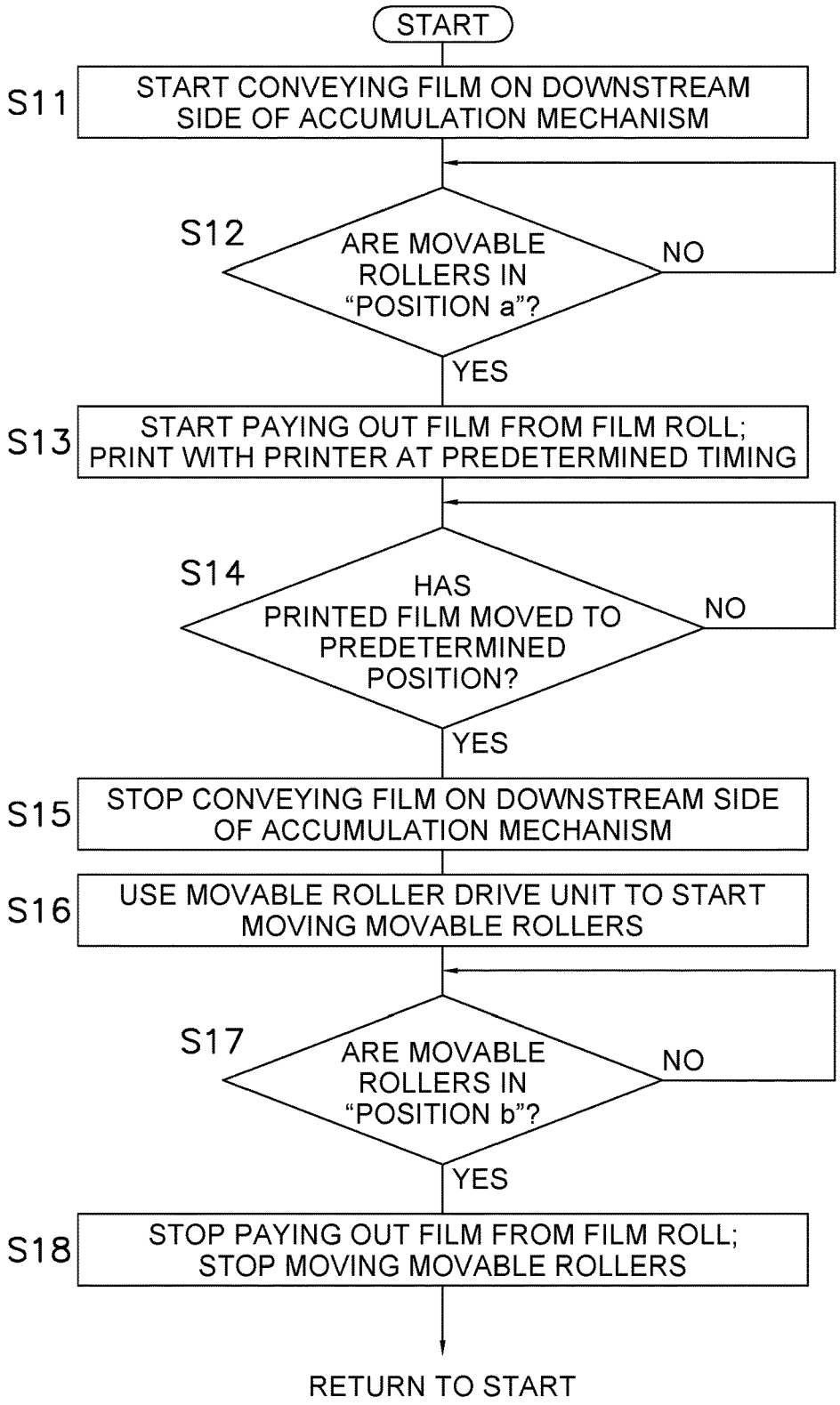
FIG. 6 is a flowchart for mainly describing the operation of the film conveyance device of the packaging apparatus of FIG. 1.

The control of the operation of the film conveyance device 100 by the controller 200 will now be described with reference to FIG. 6. FIG. 6 is a flowchart for mainly describing the operation of the film conveyance device 100.

First, film conveyance and its problems in a case where, as in a conventional packaging apparatus, the film conveyance device 100 does not have the accumulation mechanism 120 will be described.

In this packaging apparatus 1, when sealing, with the film F, the openings of the containers C in the sealing device 40, it is necessary to stop the conveyance of the film F in the sealing device 40. For that reason, if the film conveyance device 100 did not have the accumulation mechanism 120, when the conveyance of the film F is stopped in the sealing device 40, the conveyance of the film F between the film roll retention unit 110 and the sealing device 40 would also stop. Additionally, because the printer 140 performs printing on the film F conveyed by the film conveyance device 100, if the conveyance of the film F between the film roll retention unit 110 and the sealing device 40 stops, the operation of the printer 140 would also stop. As a result, in a packaging apparatus where the film conveyance device 100 does not have the accumulation mechanism 120, the amount of time in which the printer 140 is able to print on the film F becomes, at a maximum, an amount of time obtained by subtracting, from the operating time of the packaging apparatus 1, the time in which the conveyance of the film F is stopped when the openings of the containers C are sealed by the film F in the sealing device 40. For that reason, in a packaging apparatus where the film conveyance device 100 does not have the accumulation mechanism 120, the amount of time in which the printer 140 is able to print on the film F is relatively short, and particularly if the number of the containers C that the packaging apparatus 1 packages per unit of time were to be increased, this would run the risk of reducing the printing quality of the printer 140.

In contrast, in this embodiment, because the film conveyance device 100 has the accumulation mechanism 120, as described in detail below, even when the conveyance of the film F in the sealing device 40 is stopped, the conveyance of the film F can be continued between the film roll retention unit 110 and the accumulation mechanism 120. Consequently, in the packaging apparatus 1 of this embodiment, the time in which the conveyance of the film F in the sealing device 40 is stopped can also be used for time for printing on the film F. For that reason, in the packaging apparatus of this embodiment, even if the number of the containers C packaged per unit of time is increased, there is unlikely to be a reduction in printing quality on the film F.

Below, the control of the operation of the film conveyance device 100 by the controller 200 will be described.

As a premise for description, it will be assumed that at the point in time when the process of Step S11 described below is started, a predetermined length of the film F on which printing has been performed by the printer 140 has already been accumulated in the accumulation mechanism 120. In particular, here, it will be assumed that at the point in time when the process of Step S11 is started, the printed film F that is used in one sealing operation by the sealing device 40 (in this embodiment, sufficient for four of the containers C) has been accumulated in the accumulation mechanism 120. Furthermore, here, as a premise for description, it will be assumed that at the point in time when the process of Step S11 described below is started, the film conveyance device 100 has stopped conveyance of the film F on the entire conveyance path of the film F.

In this state, when the sealing device 40 finishes sealing the openings of the containers C using the film F that has already been fed to the sealing device 40, the controller 200 starts up the second shaft drive unit 134 to start conveying the film F on the downstream side of the accumulation mechanism 120 while keeping the operation of the first shaft drive unit 114 stopped (Step S11). As the film F is not fed from the film roll R1 in this state, the printed film F accumulated in the accumulation mechanism 120 is conveyed to the sealing device 40. At this time, the movable rollers 122 of the accumulation mechanism 120 move, due to tension in the film F, in the direction in which the amount of the film F accumulated in the accumulation mechanism 120 becomes less. In the example of FIG. 4, the movable rollers 122 move upward toward the fixed rollers 121 due to tension in the film F.

At this time, the controller 200 grasps the position of the movable rollers 122 using the detection result of the position sensor 126. The controller 200 determines, based on the detection result of the position sensor 126, whether the movable rollers 122 have moved to a predetermined position (referred to "position a" hereinafter) as a result of the amount of film F accumulated in the accumulation mechanism 120 has decreased (step S12).

Then, when the controller 200 determines that the movable rollers 22 have moved to "position a", the controller 200 starts up the first shaft drive unit 114 to start paying out the film F from the film roll R1 and to start conveying the film F between the film roll R1 and the accumulation mechanism 120 (Step S13). Moreover, in Step S13, the controller 200 sends operation commands to the printer 140 at appropriate timings so that the information is printed in the predetermined positions on the film F based on the detection results of the mark detection sensor 160 detecting the marks added to the film F and the amount of the film F—detected by the encoder 170—conveyed since the point in time when the marks added to the film F pass the detection position of the mark detection sensor 160. The printer 140 operates the ink ribbon 142 and the thermal head 144 to print the information on the film F in response to the operation commands.

It will be noted that the controller 200 grasps the amount of the film F fed to the sealing device 40 utilizing, for example, sensors (not shown in the drawings) disposed downstream of the accumulation mechanism 120 in the conveyance direction D in which the film F is conveyed by the film conveyance device 100. In other words, the controller 200 determines whether the printed film F that will be used in the sealing device 40 in the next packaging operation has moved to a predetermined position (Step S14).

When the controller 200 determines that the printed film F that will be used in the sealing device 40 in the next packaging operation has moved to the predetermined position (Yes in Step S14), the controller 200 stops the conveyance of the film F in the sealing device 40 so that the sealing device 40 can seal, with the film F, the openings of the containers C. Specifically, when the controller 200 determines that the printed film F that will be used in the sealing device 40 in the next packaging operation has moved to the predetermined position, the controller 200 stops the conveyance of the film F downstream of the accumulation mechanism 120 in the conveyance direction D of the film F. More specifically, when the controller 200 determines that the printed film F that will be used in the sealing device 40 in the next packaging operation has moved to the predetermined position, the controller 200 stops operating the second shaft drive unit 134 to stop the conveyance of the film F on the downstream side of the accumulation mechanism 120 in the conveyance direction D of the film F (Step S15).

Moreover, at this point in time, the controller 200 drives the movable roller drive unit 124 to move the movable rollers 122 so as to increase the amount of the film F accumulated in the accumulation mechanism 120 (Step S16). In the example of FIG. 4, the controller 200 drives the movable roller drive unit 124 to move the movable rollers 122 downward. By moving the movable rollers 122 downward in this way, the conveyance of the film F on the upstream side of the accumulation mechanism 120 can be continued while the conveyance of the film F on the downstream side of the accumulation mechanism 120 is stopped.

It will be noted that the controller 200 also continues the process of sending the operation commands at appropriate timings to the printer 140 until the determination result becomes "Yes" in step S17 described later.

The controller 200 uses the detection result of the position sensor 126 to grasp the position of the movable rollers 122 that are moving so as to increase the amount of the film F accumulated in the accumulation mechanism 120. The controller 200 determines, based on the detection result of the position sensor 126, whether the amount of the film F accumulated in the accumulation mechanism 120 has increased and the movable rollers 122 have moved to a predetermined position (referred to "position b" hereinafter) (Step S17). It will be noted that the "position b" here is set so that the film F that is utilized for one packaging operation in the sealing device 40 has been accumulated in the accumulation mechanism 120 when the movable rollers 122 are in this position.

When the controller 200 determines in step S17 that the movable rollers 122 are in the "position b", the controller 200 stops operating the first shaft drive unit 114 and stops operating the movable roller drive unit 124 (Step S18).

It is preferred that the "position b" used in the determination of Step S17—in other words, the position of the movable rollers 122 when the film F has accumulated the most in the accumulation mechanism 120—be configured so that the controller 200 which serves as the changing unit can change the "position b" in response to input to the input unit 210. In other words, it is preferred that the controller 200 change the maximum film length accumulable by the accumulation mechanism 120 in response to input to the input unit 210. By configuring the controller 200 in this way, even when the size of the containers C packaged by the packaging apparatus 1, the quantity of the containers C packaged at one time by the sealing device 40, and/or the positions in which the printer 140 prints on the film F change, the film F can be stopped at an appropriate position that will not affect printing by the printer 140 when temporarily stopping the conveyance of the film by the film conveyance device 100. In other words, by virtue of having the changing unit, it can be ensured that the film F is not stopped in the middle of printing by the printer 140.

It will be noted that although a case where the changing unit is the controller 200 has been described as an example here, the changing unit is not limited to this.

The changing unit may also, for example, be a frame 128 to which the movable rollers 122 are movably attached. The frame 128 here is a member whose position relative to a mainframe (not shown in the drawings) of the packaging apparatus 1 can be changed. Preferably, the frame 128 is a member whose position relative to the mainframe can be manually changed. However, the frame 128 may be a member whose position relative to the mainframe is changed by a drive unit such as a motor rather than manually. It will be noted that, here, the fixed rollers 121 of the accumulation mechanism 120 are fixed to the mainframe. The frame 128 is configured so that the distance between the movable rollers 122 and the fixed rollers 121 at the time when the movable rollers 122 are disposed in the position farthest away from the fixed rollers 121 in the frame 128 can be changed in accordance with a change in the position of the frame 128 relative to the mainframe.

(3) Characteristics (3-1)

The packaging apparatus 1 of the above embodiment includes the film conveyance device 100 serving as an example of a film conveyance unit, the moving mechanism 30 serving as an example of a container conveyance unit, the sealing device 40 serving as an example of a packaging unit, the printer 140 serving as an example of a printing unit, and the controller 200 serving as an example of a control unit. The film conveyance device 100 conveys the film F. The moving mechanism 30 conveys the container C having an opening. The sealing device 40 seals, with the film F conveyed thereto by the film conveyance device 100, the opening of the container C conveyed thereto by the moving mechanism 30. The printer 140 is disposed upstream of the sealing device 40 in the conveyance path along which the film F is conveyed by the film conveyance device 100. The printer 140 prints information in a predetermined position on the film F while the film F being conveyed by the film conveyance device 100. The controller 200 controls the operations of the film conveyance device 100, the moving mechanism 30, the sealing device 40, and the printer 140. The film conveyance device 100 has the accumulation mechanism 120. The accumulation mechanism 120 is disposed between the printer 140 and the sealing device 40 in the conveyance path of the film F. The accumulation mechanism 120 temporarily accumulates the film F printed with the information. The controller 200 controls the film conveyance device 100 so that the accumulation mechanism 120 accumulates at least the film F that is utilized for one packaging operation in the sealing device 40.

In the packaging apparatus 1 of the above embodiment, the time in which conveyance of the film F is stopped or slowed down on the downstream side of the accumulation mechanism 120 in the conveyance path of the film F can also be utilized for time for printing on the film F. For that reason, in the packaging apparatus 1, time for printing can be ensured and a high printing quality on the film F can be maintained.

(3-2)

In the packaging apparatus 1 of the above embodiment, the conveyance speed of the film F from the printer 140 to the accumulation mechanism 120 is slower than the conveyance speed of the film F downstream of the accumulation mechanism 120.

In this packaging apparatus 1, by virtue of having the accumulation mechanism 120, it is not necessary to synchronize the printing speed of the printer 140 with the conveyance speed of the film F on the downstream side of the accumulation mechanism 120. For that reason, in this packaging apparatus 1, a high printing quality on the film F can be maintained even when the film F is fed at a high speed to the printer 140.

(3-3)

In the packaging apparatus 1 of the above embodiment, the film conveyance device 100 conveys the film F in the printer 140 while stopping conveyance of the film F in the sealing device 40 at least for a predetermined period of time.

Because the packaging apparatus 1 of the above embodiment has the accumulation mechanism 120, the time in which conveyance of the film F is stopped for packaging can be utilized for time for printing on the film F by the printer 140. For that reason, in the packaging apparatus 1, a high printing quality on the film F can be maintained.

(3-4)

In the packaging apparatus 1 of the above embodiment, the sealing device 40 collectively seals, with the film F, the openings of a plurality of the containers C lined up parallel to the conveyance direction of the film F in the sealing device 40 in the one packaging operation.

In this packaging apparatus 1, it becomes necessary to feed a length of the film F sufficient for the plural containers for every packaging operation by the sealing device 40. For that reason, if the packaging apparatus 1 did not have the accumulation mechanism, it would be necessary to complete the plural containers' worth of printing in, at most, the amount of time from the end of a packaging operation to the start of the next packaging operation.

In contrast, because the packaging apparatus 1 has the accumulation mechanism 120, the film F can be conveyed and printing can be performed on the film F even during execution of the packaging operation, and a high printing quality on the film F can be maintained.

(3-5)

The packaging apparatus 1 of the above embodiment includes the changing unit that changes a maximum film length accumulable by the accumulation mechanism 120.

The changing unit is, for example, the controller 200 that changes the "position b" used in step S17 of the flowchart of FIG. 6 in response to input to the input unit 210.

Furthermore, the changing unit may also, for example, be the frame 128 to which the movable rollers 122 are movably attached. The frame 128 here is a member whose position relative to the mainframe (not shown in the drawings) of the packaging apparatus 1 can be changed. Preferably, the frame 128 is a member whose position relative to the mainframe can be manually changed. However, the frame 128 may also be a member whose position relative to the mainframe is changed by a drive unit such as a motor rather than manually. It will be noted that, here, the fixed rollers 121 of the accumulation mechanism 120 are fixed to the mainframe. The frame 128 is configured so that the distance between the movable rollers 122 and the fixed rollers 121 at the time when the movable rollers 122 are disposed in the position farthest away from the fixed rollers 121 in the frame 128 can be changed in accordance with a change in the position of the frame 128 relative to the mainframe.

It will be noted that the changing unit described here is merely exemplary and that the changing unit may have other structures/configurations as long as it is able to change the maximum film length accumulable by the accumulation mechanism 120.

In the packaging apparatus 1 of the above embodiment, even when the size of the containers C, the quantity of the containers C packaged at one time by the sealing device 40, and/or the positions in which the printer 140 prints on the film F change, the film F can be stopped at an appropriate position that will not affect printing by the printer 140 when temporarily stopping conveyance of the film F by the film conveyance device 100. In other words, by virtue of having the changing unit, it can be ensured that the film F is not stopped in the middle of printing by the printer 140.

(3-6)

The packaging apparatus 1 of the above embodiment stops the printing operation in the printer 140 in a case where the film F that is utilized for the one packaging operation in the sealing device 40 is accumulated in the accumulation mechanism 120.

In the packaging apparatus 1, the film conveyance device 100 stands by in a state in which the film F that is used for one packaging operation has been accumulated in the accumulation mechanism 120, so the film F printed with the information can be provided without delay to the sealing device 40 in correspondence with the timing of the operation of the sealing device 40.

At the same time, the accumulation mechanism 120 does not overly accumulate the film F, so the size of the accumulation mechanism 120 can be inhibited from being excessively large.

(4) Example Modifications

Example modifications of the embodiment will be described below. It will be noted that the example modifications described below may be appropriately combined to the extent that they are not mutually contradictory.

(4-1) Example Modification A

In the above embodiment, a case where the printer 140 is a thermal transfer printer using the ink ribbon 142 was described as an example, but the type of the printer 140 is not limited to a thermal transfer printer. For example, a substance that produces color by heat may be partially applied to the film F beforehand, so that printing can be performed on the film F without using the ink ribbon 142. Furthermore, the configuration of the above embodiment is also useful in a case where, for example, the printer 140 is an inkjet printer.

(4-2) Example Modification B

In the above embodiment, a plurality of the containers C are gathered on the second conveyor 20, the moving mechanism 30 conveys the plural containers C to the sealing device 40, and the sealing device 40 collectively seals, with the film F, the openings of the plural containers C.

However, the packaging apparatus 1 is not limited to this. The moving mechanism 30 may convey the containers C one at a time to the sealing device 40, and the sealing device 40 may seal, with the film F, the opening of a single container C. However, in terms of efficiently packaging the containers C, it is preferred that the moving mechanism 30 convey a plurality of the containers C to the sealing device 40 and that the sealing device 40 seal, with the film F, the openings of the plural containers C.

(4-3) Example Modification C

In the above embodiment, the moving mechanism 30 moves the predetermined quantity of the containers C that have been gathered on the second conveyor 20 to the sealing device 40 and simultaneously moves the packaged containers C that are on the sealing device 40 to the third conveyor 50. However, the packaging apparatus 1 is not limited to this. The packaging apparatus 1 may have a first moving mechanism that moves the predetermined quantity of the containers C that have been gathered on the second conveyor 20 to the sealing device 40 and a second moving mechanism, separate from the first moving mechanism, that moves the packaged containers C that are on the sealing device 40 to the third conveyor 50.

INDUSTRIAL APPLICABILITY

The present invention can be widely used in packaging apparatus that seal, with a film, openings of containers contained thereto, and is useful.

REFERENCE SIGNS LIST

1 Packaging Apparatus
30 Moving Mechanism (Container Conveyance Unit)
40 Sealing Device (Packaging Unit)
100 Film Conveyance Device (Film Conveyance Unit)
120 Accumulation Mechanism
128 Frame (Changing Unit)
140 Printer (Printing Unit)
200 Controller (Control Unit, Changing Unit)
C Containers
F Film

CITATION LIST

Patent Literature

Patent Document 1: JP-A No. H10-203505

What is claimed is:

1. A packaging apparatus comprising:

a film conveyance unit configured to convey a film;

a container conveyance unit configured to convey a container having an opening;

a packaging unit configured to seal, with the film conveyed thereto by the film conveyance unit, the opening of the container conveyed thereto by the container conveyance unit;

a printing unit disposed upstream of the packaging unit in a conveyance path along which the film is conveyed by the film conveyance unit and configured to print information in a predetermined position on the film while the film being conveyed by the film conveyance unit; and a control unit configured to control the film conveyance unit, the container conveyance unit, the packaging unit, and the printing unit, wherein the film conveyance unit has an accumulation mechanism disposed between the printing unit and the packaging unit in the conveyance path of the film and configured to temporarily accumulate the film printed with the information, the control unit is configured to control the film conveyance unit so that the accumulation mechanism accumulates the film that is utilized for at least one packaging operation in the packaging unit, the control unit conveys the film from the printing unit to the accumulation unit regardless of whether the film is conveyed from the accumulation unit to the packaging unit, and the accumulation unit accumulates the film when the film is conveyed from the printing unit to the accumulation unit and the film is not conveyed from the accumulation unit to the packaging unit.

2. The packaging apparatus of claim 1, wherein a conveyance speed of the film from the printing unit to the accumulation mechanism is slower than a conveyance speed of the film downstream of the accumulation mechanism.

3. The packaging apparatus of claim 1, wherein the film conveyance unit is configured to convey the film in the printing unit while stopping conveyance of the film in the packaging unit at least for a predetermined period of time.

4. The packaging apparatus of claim 3, wherein the packaging unit is configured to collectively seal, with the film, the openings of a plurality of the containers lined up parallel to a conveyance direction of the film in the packaging unit in the one packaging operation.

5. The packaging apparatus of claim 1, wherein the accumulation mechanism includes a movable roller around which the film is wound, and a position of the movable roller is changeable to change a maximum film length accumulable by the accumulation mechanism.

6. The packaging apparatus of claim 1, wherein the packaging apparatus is configured to stop a printing operation in the printing unit in a case where the film that is utilized for the one packaging operation in the packaging unit is accumulated in the accumulation mechanism.

* * * * *